US007942124B2

(12) United States Patent
Harbert

(10) Patent No.: US 7,942,124 B2
(45) Date of Patent: May 17, 2011

(54) EXPOSED COIL ROCKER ARM COVER ASSEMBLY HAVING EXTERNAL MULTI-COIL MOUNTING BRACKET

(76) Inventor: Richard H. Harbert, Mukilteo, WA (US)

( * ) Notice: Subject to any disclaimer, the term of this patent is extended or adjusted under 35 U.S.C. 154(b) by 667 days.

(21) Appl. No.: 12/058,418

(22) Filed: Mar. 28, 2008

(65) Prior Publication Data

US 2009/0241879 A1 Oct. 1, 2009

(51) Int. Cl.
*F01M 9/10* (2006.01)
*F02F 7/00* (2006.01)

(52) U.S. Cl. ..... 123/143 R; 123/195 C; 123/198 E; 123/90.38

(58) Field of Classification Search ..... 123/90.38, 123/195 C, 198 E, 143 R, 634, 635, 647
See application file for complete search history.

(56) References Cited

U.S. PATENT DOCUMENTS 5,003,958 A * 4/1991 Yoneyama et al. ..... 123/635
5,323,745 A 6/1994 Sato et al.
5,390,648 A * 2/1995 Yanase ..... 123/634
5,771,850 A * 6/1998 Okada ..... 123/143 C
6,328,010 B1 * 12/2001 Thurman ..... 123/143 C
6,494,193 B2 12/2002 Weingaertner et al.
6,622,711 B1 9/2003 Skinner et al.
6,843,217 B2 * 1/2005 Zwick et al. ..... 123/143 C
7,025,027 B2 * 4/2006 Kraus et al. ..... 123/143 C
7,341,038 B1 * 3/2008 Forish et al. ..... 123/195 C
7,350,488 B2 4/2008 Harbert
D574,853 S * 8/2008 Harbert ..... D15/5
7,789,079 B2 * 9/2010 Harbert ..... 123/635

* cited by examiner

*Primary Examiner* — John T Kwon
*Assistant Examiner* — Johnny H Hoang
(74) *Attorney, Agent, or Firm* — Innovation Law Group, Ltd.; Jacques M. Dulin, Esq.

(57) ABSTRACT

An improved rocker arm cover assembly having an enclosed rocker arm chamber housing and a generally L-shaped bracket for mounting multiple coils to an exterior vertical side wall of the housing, so that the coils are exposed and laterally displaced from the housing. The bottom of the housing includes special seal and flange members to permit sealing mounting to the engine head so that the rocker arm chamber is isolated as a "wet" enclosure from the coil bracket assembly. The housing is mounted directly to the head via a plurality of through bolts. A fully isolated, dual function, oil fill/PCV valve conduit is provided through the top of the housing to permit adding lubrication oil or permitting exhaust of crankcase vapors without contaminating the coils, and permitting independent servicing of the coils. Several variations of coils and coil mounting brackets are disclosed.

16 Claims, 6 Drawing Sheets

EXPOSED COIL ROCKER ARM COVER ASSEMBLY HAVING EXTERNAL MULTI-COIL MOUNTING BRACKET

FIELD

The invention relates to the field of automotive parts, and more particularly to an improved rocker arm cover assembly having an enclosed rocker arm chamber that includes special seal and flange members to mate with the engine head, and an exposed, exterior bracket plate on which a plurality of coils is mounted. A fully isolated dual-function conduit is provided through the rocker arm chamber top wall to function either as an oil fill tube to permit adding lubrication oil without contaminating the coils or as a crankcase vapor exhaust to the air intake manifold via a PCV valve fitted in the conduit. A plurality of coil and coil mounting bracket designs are disclosed.

BACKGROUND

Conventional after-market valve covers or rocker arm covers (RACs) comprise a thin sheet metal or plastic cover mounted on the engine head(s). These covers have a single cavity that encloses the rocker arms, valve return springs and pushrods that together actuate the cylinder valve stems. In more recent model engines equipped with a Distributorless Ignition Systems (DIS), a plurality of ignition coils, one for each cylinder in the engine, are separately mounted in association with the head or the plugs. For the typical V8 engine, two rocker arm covers are employed, one for each bank of 4 cylinders.

Several approaches have been tried for mounting of the coils in a manner to not interfere with the cover. In Weingaertner U.S. Pat. No. 6,494,193, for example, a stepped design for a straight-4 engine is employed wherein a large shallow-height base case covers both the rocker arms and the spark plugs. There is a smaller elevated casing atop the base that contains the coils. Leads are embedded in the plastic and oil-proof boots must be used to connect the leads to the plug. This approach suffers the serious disadvantage of having no separate oil fill, requires removal of 13 bolts to remove the base cover to access the plugs, and it houses the plugs and boots in the "wet" zone, the same space as the rocker arms, where they are continuously exposed to oil and hydrocarbon vapors.

Skinner U.S. Pat. No. 6,622,711 also uses a large cover over the plugs and a separate coil cassette (container) that fits within the large cover directly over the plugs. The coils connect to the plugs via boots as in Weingaertner. Although the engine is only shown schematically, and as a straight 4, the large cover is co-extensive with the head, so the coils are in the wet zone, albeit within a separate cassette. To access the coil cassette, 16 bolts and the large cover have to be removed.

Sato U.S. Pat. No. 5,323,745 shows a single, plastic rocker arm cover over dual camshafts and valve stems with an oil/gas separation chamber mounted on the underside of the cover. The plugs are in the wet chamber defined by the cover and a coil arrangement is not disclosed, so it appears this patent is directed to a distributor-type ignition system.

Industrie Magneti Marelli in EP Application 0-512-357-A2 (Nov. 11, 1992) provides "plug-top" ignition coils located in a 2-part housing comprising upper and lower flanged housings that are bolted together (apparently 16 bolts) at the flanges. The coils are located in the housing. Projecting from the bottom is a boot that fits over the spark plugs. The top housing includes 4 caps, each providing input lead access to the coil below. This unit is independent of a rocker arm cover and rides on the plugs themselves, rather than being separately mounted, so the unit puts weight and torsional strain on the plugs.

As can be seen from such exemplary unsatisfactory designs, there is a long felt, but unmet need in the art for a cleaner, tidier rocker arm and coil assembly that prevents cross contamination, permits simultaneous mounting of all 4 coils, yet provides full and independent access for replacement and servicing, is robust under severe service conditions, has a useful life far longer than stamped sheet metal or plastic, and is simple and faster to install.

THE INVENTION

Summary, Including Objects and Advantages

The invention is directed to an improved rocker arm cover (RAC) for internal combustion engines, and more particularly to a side-by-side design in which a rocker arm chamber housing is mated to an exposed bracket mounted to an external face of the rocker arm chamber which bracket retains multiple coils. Each coil is mounted to the bracket via 2 screws, and the bracket in turn is mounted to an exterior face of the rocker arm chamber housing. Thus the coils are not placed in a wet zone, and may be independently serviced or changed-out independent of the rocker arm chamber housing. The rocker arm chamber housing also includes a tube or passage that has dual function. It may receive a cap having a bayonet groove that mates with a tang on the inner surface of the tube for secure sealing and to function as an oil fill conduit. In the alternative, the tube may be fitted with a Positive Crankcase Ventilation (PCV) valve to permit pressure equalization in the crankcase. The PCV valve includes an output port that feeds vapors via a line to the air intake manifold so the crankcase vapors are burned during combustion, reducing pollution. The exemplary rocker arm cover of this invention is described in reference to a 4-cylinder bank of a V-8 engine, so that there are two complementary rocker arm covers employed for each such V-8 engine.

The inventive RAC comprises a single, generally elongated, open bottom housing having a plurality of parts and features. In plan view, the housing is generally rectangular with rounded ends, classified as "stadium" shaped, and in vertical cross-section is generally an inverted-U shape and has a generally horizontal top wall spanning between the vertical side walls opposite the open bottom. The housing may be made of aluminum or a rugged plastic or composite composition of the type used in automotive applications in conjunction with engine compartments, and is preferably aluminum, such as alloy 6061 (more than adequate), 2024 for more rugged use, and Alcoa 7075-2 aircraft aluminum for extreme use, or a carbon-fiber composite. The top wall may be tapered laterally along the entire longitudinal length.

The housing comprises a rocker arm chamber. The housing is open at the bottom to fit over the engine head. The exterior vertical wall of the housing is continuous and terminates at a lower margin in a groove that receives a seal member (gasket), which in a preferred embodiment is a flanged O-ring. Approximately half of that lower margin terminates in an internal, vertically downwardly extending lip or drip rail, lying inside the O-ring seal. The partial lip engages a corresponding shoulder (or optional groove) in the engine head. That drip rail keeps oil from running directly across and puddling on the lowest portion of the seal ring gasket so that it reduces degradation of the gasket material, extending its life and preventing leakage at that point. Typically the drip rail lip rests on the lowest vertical wall of the cylinder head, and also provides an alignment function that insures the inventive RAC housing is properly fitted on the head before the securing bolts are inserted and tightened.

The top includes a plurality of mounting bosses having recessed holes that permit insertion of the mounting bolts to secure the RAC chamber housing to the head. Preferably, these bosses project downwardly from the underside of the top plate. That is, the bosses project into the rocker arm chamber, while the recesses are accessible from the exterior. Thus, the RAC is secured to the head independently of the coil bracket.

The external coil bracket plate means that only two mounting screws need be provided to thread into bosses in a sidewall of the RAC chamber housing. The bracket is secured to these two bosses, one generally at each end. Thus the entire coil assembly can be assembled separately on the bench, and then secured as a group via the bracket to the side of the RAC coil chamber housing. The preferred embodiment of the coil bracket orients the coils at about a 60 degree angle with respect to the longitudinal axis of both the inventive RAC assembly housing and the bracket. This permits use of coils with long tubular spark plug wire sockets. In a second embodiment, the bracket is configured for orthogonal placement of the coils. In each embodiment, only two screws are required to secure each coil in place.

The bracket comprises a generally L-shaped plate, with the foot being placed against a side wall of the RAC chamber housing exterior wall. The foot includes a number of slots so as to be universal, that is, it accommodates a wide variety of RAC housing lengths and variable placement of the securing bosses in the RAC chamber housing side wall.

The inventive RAC pair for each engine may be alike, in which case in one of the two covers, a port or conduit is provided extending from the exterior surface of the top and communicating with the rocker arm chamber. This conduit is adapted with an internal tang and a bayonet cap to function as an oil fill port. The other variation of the RAC unit conduit is adapted with a flange and fitted with a standard Positive Crankcase Ventilation valve (PCV valve) instead of the cap for pressure balance ventilation of the crankcase. The output of from the PCV valve is connected by a vacuum hose to an input in the air intake manifold. In this preferred embodiment (the two variations of the conduit), the passenger side RAC unit of the invention is the oil fill port and cap version which is oriented at the front of the engine, while the PCV valve version is oriented with the conduit and PCV valve adjacent the firewall. Alternately, the RAC unit castings may be mirrored, that is, chiral orientation of the parts with respect to each other. Stated another way, there may be a Left handed RAC and a Right handed RAC, so that the oil fill cap version and the PCV version are both oriented toward the front or the back of the engine. Typically and normally, the port is oriented to the front of the cylinder head on the passenger side and on the back on the driver's side.

The oil fill/PCV valve conduit is an important feature of the improved RAC. The conduit extends from the top, outer surface of the top into the RAC chamber, thus providing an isolated conduit for introduction of lubricating oil directly into the rocker arm chamber or the exhaust of blow-by vapors and pressure in the crankcase, as the case may be. The conduit is closed by a cap for the oil fill version and by a standard PVC valve in the crankcase vent version. It is preferred that a bayonet and groove assembly be used for the oil fill cap, and in the preferred embodiment, the cap includes a groove in its stem while the interior surface of the tube includes a tang that engages the bayonet groove of the cap. The cap also includes a seal member, preferably an O-ring.

An important aspect of the inventive RAC assembly is the provision of the separate, exposed coil bracket In that way, either the individual coils can be removed for service or replacement, or the entire bracket can be removed from the RAC chamber housing with coils still attached for servicing at a bench. This independent "lift-off" of coils for service functionality is an important feature of the external bracket design of the inventive RAC assembly.

Accordingly, the inventive RAC includes multiple functionalities that cooperate to provide complete, but independent access to the various engine parts needing service or replacement independent of each other, with each isolated from the others. The oil fill cap can be removed and oil added without taking off the coil cover. The coil bracket can be taken off and either individual coils serviced or replaced, or individual coils serviced by unscrewing the two screws securing the coil to the bracket. Those functions are accomplished without removing the rocker arm housing from the head. Or the housing removed by removing the four securing bolts for access to the rocker arms, springs and pushrods, without disturbing the coil layout.

BRIEF DESCRIPTION OF THE DRAWINGS

The invention is described in more detail with reference to the photographs of a prototype of the inventive external coil bracket RAC assembly, in which.

DETAILED DESCRIPTION, INCLUDING THE BEST MODES OF CARRYING OUT THE INVENTION

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention, including what is presently believed to be the best modes of carrying out the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

All publications, patents and applications cited in this specification are herein incorporated by reference as if each individual publication, patent or application had been expressly stated to be incorporated by reference.

Figure 1:
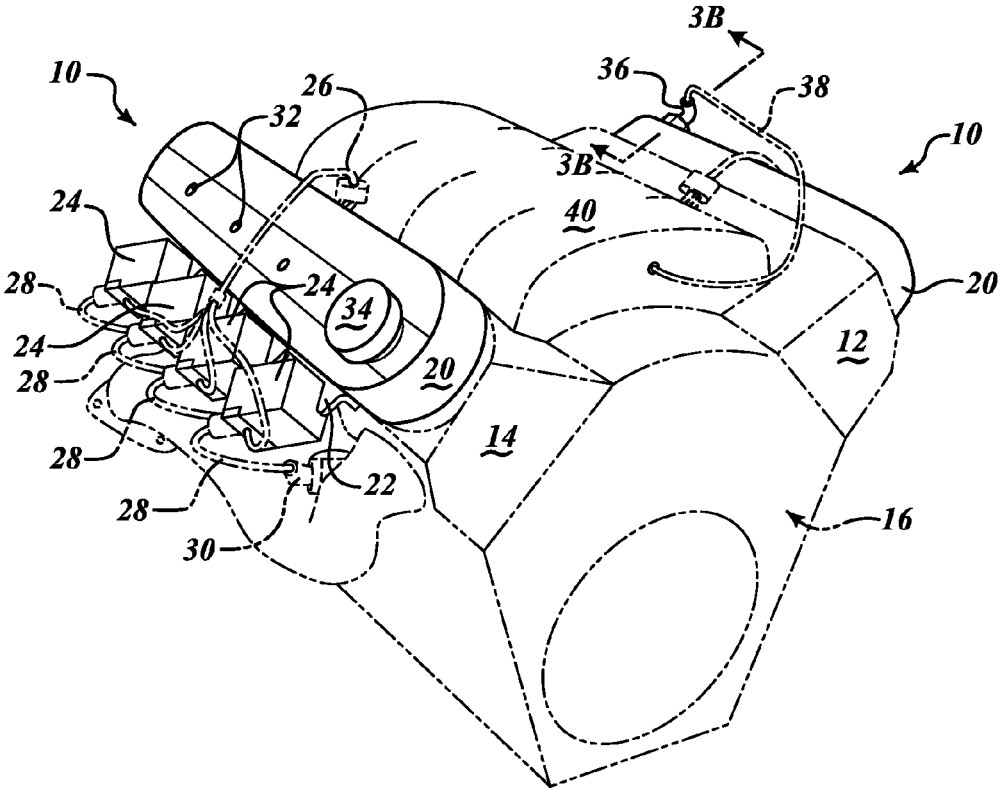
FIG. 1 is an isometric view of an exemplary V-8 engine on which an inventive exposed coil rocker arm cover assembly has been mounted on each cylinder head.

FIG. 1 shows in isometric a pair of inventive RAC assemblies 10 operatively mounted in place on the driver's side cylinder head 12 of a V-8 engine, and on the passenger side cylinder head 14. The inventive RAC assembly comprises a rocker arm housing 20 on the outer vertical side wall of which is mounted a coil bracket 22. A plurality of coils 24, in this example four for each cylinder head are mounted externally of the housing 20 on the bracket 22. An electrical, multi-wire lead 26 feeds the timed signals from the engine operation microprocessor to the respective coils, and in turn, the output spark voltage is fed from each coil 24 via a wire lead 28 to the respective spark plugs 30. The housing 20 is bolted to the head 14 by a plurality of bolts 32. An oil fill cap 34 is fitted in the port of one of the housings, and a PCV Valve 32 is mounted in the port of the other housing 10, in this example mounted to the driver's side head 12. The PCV output vapor line 38 carries the vapors to the inlet air shroud 40 for combustion.

Figure 2:
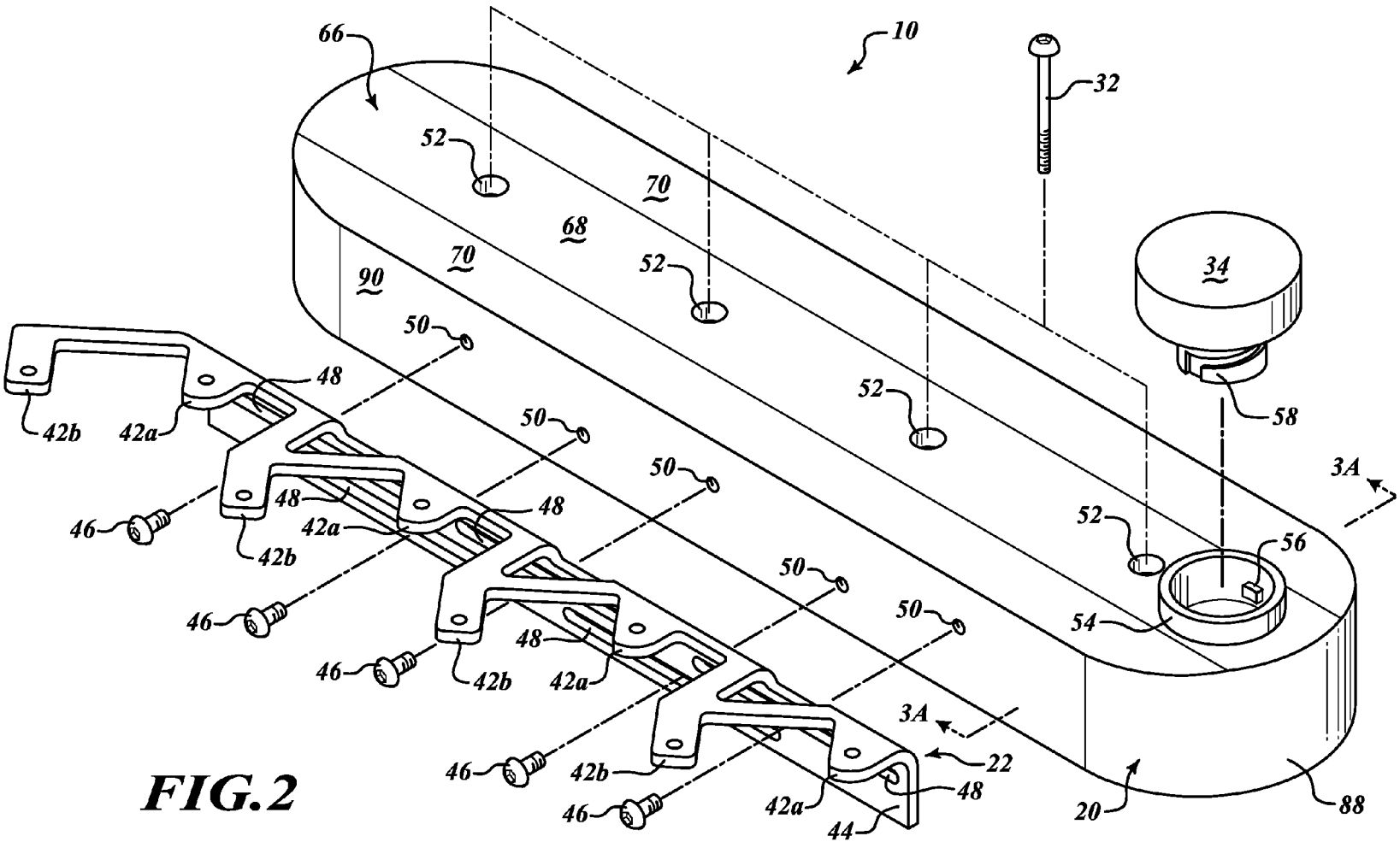
FIG. 2 is an exploded isometric view of the inventive exposed coil RAC showing the bracket in the foreground and the rocker arm housing in the rear.

FIG. 2 shows the coil bracket 22 as having a plurality of generally horizontal pairs of arms 42*a*, 42*b* extending outwardly and laterally from bracket foot 44, which is oriented orthogonally and vertically to the arms. The bracket foot 44 is secured to the vertical, longitudinal side wall 90 of the housing 20 by screws 46 passing through slots 48 in the foot to be secured in the threaded holes 50 in the housing side wall 90. By way of example only, in the embodiment shown, the bracket arm pairs 42*a, b* are set at an acute angle with respect to the vertical plane of the foot. The foot in this example has 5 slots that are both horizontally and vertically staggered and spaced so that two screws 48 are in the lower two spaced slots, and three above. The slots permit fore/aft longitudinal adjustment of the coils with respect to the plugs so that the wires and coil nozzles do not interfere with each other or the plug wire end fittings, depending on the make and model of engine. This makes the inventive exposed coil RAC assembly universal with respect to engine types. One skilled in the art will recognize that the number of foot slots and their configurations and the shape and angle of the coil mounting arms may be varied as needed to provide the appropriate clearances needed for any particular engine and coil footprint.

Note the RAC housing 20 has continuous vertical side walls, flat on the long sides 90 and curved at the ends 88. In plan view the housing is generally stadium shaped. The housing top plate or wall 66, in this embodiment has a central flat outer surface area 68 in which a plurality of counter-sunk recesses 53 are provided to receive the mounting bolts 32. The flanks of the central area 68 are planar, sloped shoulders 76. One skilled in the art will recognize that other upper surface configurations are equally suitable.

The housing top 68 includes a port 54 adjacent one end. This port serves dual function, both for oil fill and for fitting with a PCV valve. In the FIG. 2 embodiment, the port is fitted with an oil fill cap 34 having a helical groove 58 that engages a tang 56 on the port wall. One skilled in this art will recognize that the port 54 may be placed in other locations in the top as engine configurations may require, for example in the longitudinal center rather than adjacent one end as shown.

Figure 3A:
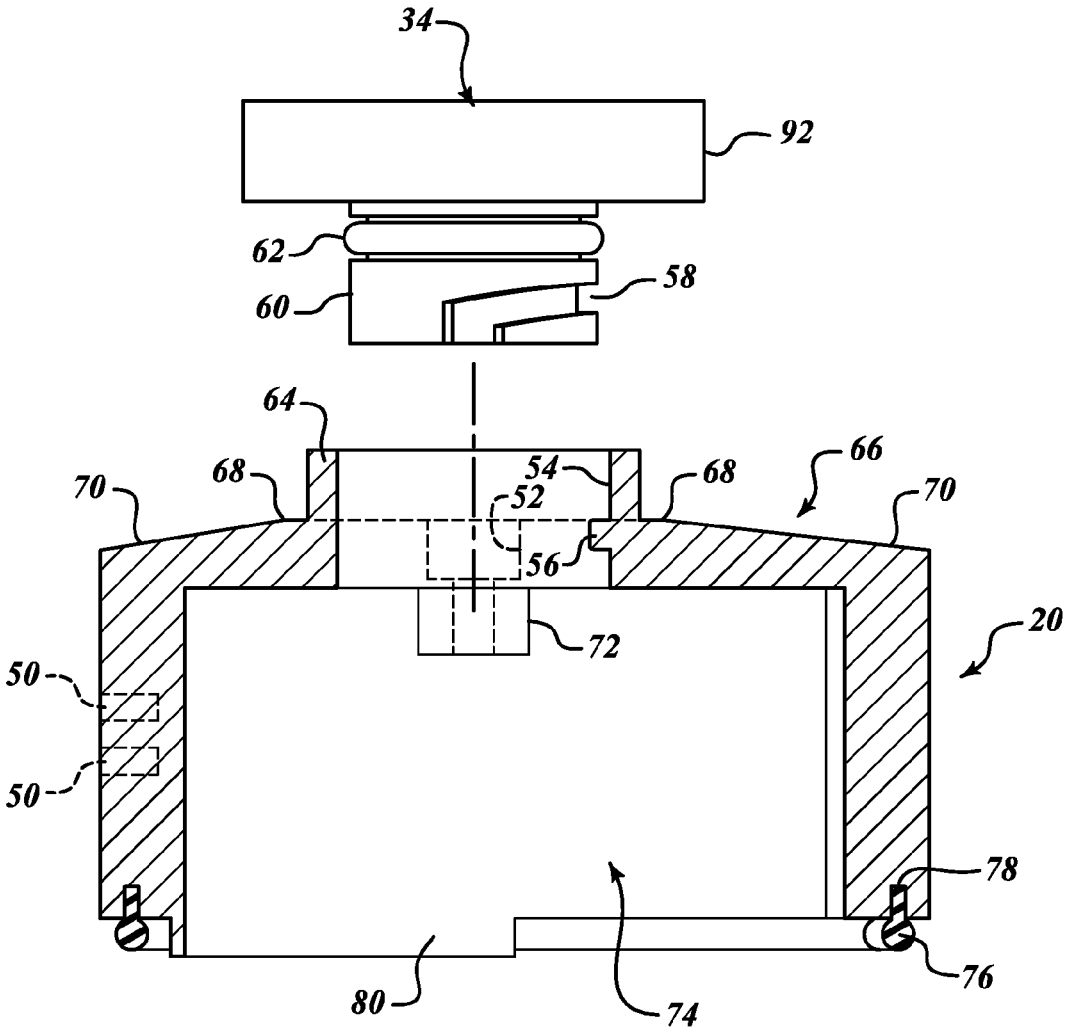
FIG. 3A is a section view through the line 3A-3A of FIG. 2 showing the detail of the oil fill cap and housing top wall port.
Figure 3B:
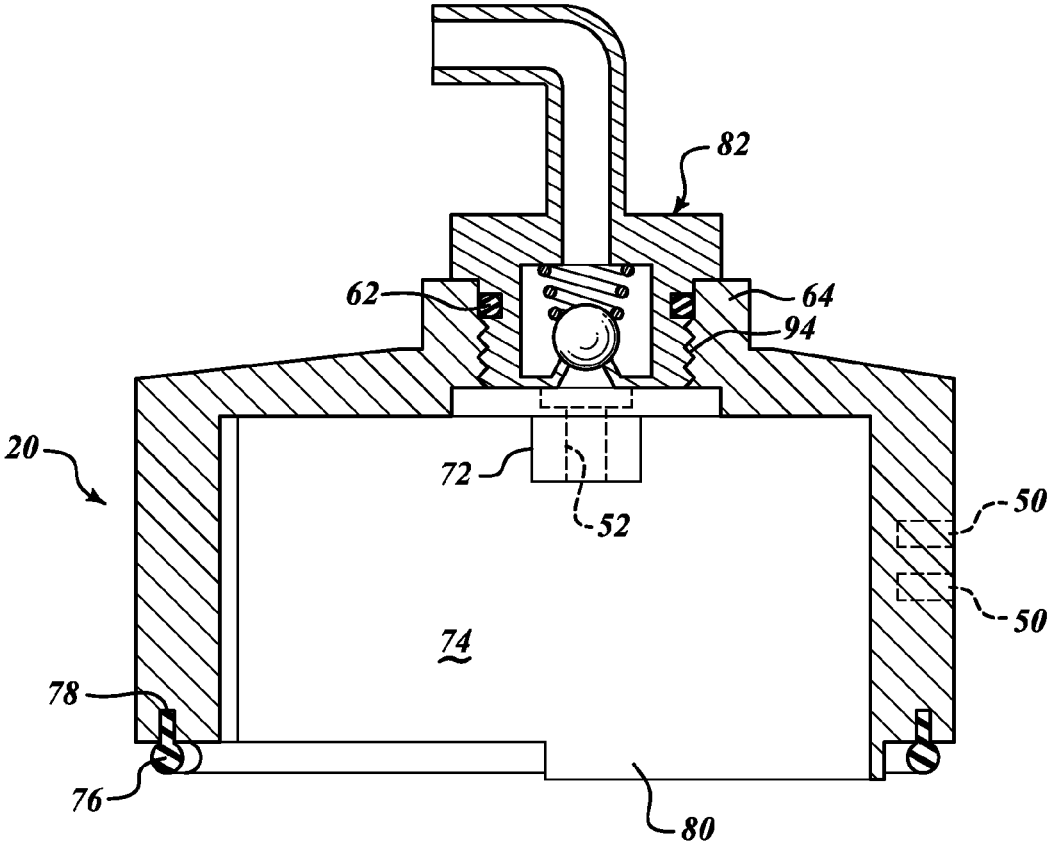
FIG. 3B is a section view through the line 3B-3B of FIG. 2 showing the detail of the PCV valve fitted into a threaded port in the top wall of the housing.

FIGS. 3A and 3B show two versions of the fitting for the port 54. In both the port comprises a neck or collar 64 projecting above the top flat surface 68. In the FIG. 3A version, the port bore includes a tang 56 that engages the helical bayonet groove 58 in the shank or neck 60 of the cap 34. The cap outer margin 92 may be knurled or scalloped to facilitate gripping by hand for removal and reseating. An O-ring seal 62 is preferably provided in a groove of the neck as shown to insure a leak-proof seal. Oil is added to the engine through port 54 after removal of the cap 34. Upon turning the cap clockwise, the tang 56 engages the groove 58 and cinches the cap 34 down tight to the top 68 by following the cam surface of the groove.

Note the stud 72 projects into the rocker arm chamber space 74 to provide a web of material for the securing bolt bore 52. The bottom marginal face of the vertical side wall 90 includes a slot 78 into which is fitted a continuous perimeter flanged seal member 76. A partial flange or lip 80 extends approximately half way around the perimeter of the bottom edge margin, from center line at one end to center line at the opposed longitudinal end. This lip engages a groove in the head, on the downward longitudinal edge. This lip and groove, plus the seal prevents oil from leaking onto the spark plugs and exhaust manifold. Note that the lip is on the bracket side of the housing, as seen by the bracket securement holes 50.

In the FIG. 3B version, the inner bore of the port 54 is threaded, 94, to receive a PCV valve assembly 82. An O-ring seal 62 is provided in the valve. In this version, shown at the driver's side head in FIG. 1, a standard PCV valve 82 is inserted (e.g., screwed) into the port bore in place of the cap. Typically, AN-10 or AN-12 fuel or breather system type threads 94 may be used. An optional O-ring 62 may be used to sealingly engage the port bore in either the cap or the PCV valve versions. The standard PCV valve includes a ball valve and a biasing spring so that blowby and vapors from the crankcase, via the rocker arm chamber 74 are sucked out of the crankcase, via the PCV valve, to be input into the air intake manifold (standard vacuum line shown in FIG. 1), where the vapors are mixed with the air/fuel mix for combustion in the cylinders. The chamber 74, side walls, bottom edge, seal and lip are the same as in FIG. 3A.

Figure 4A:
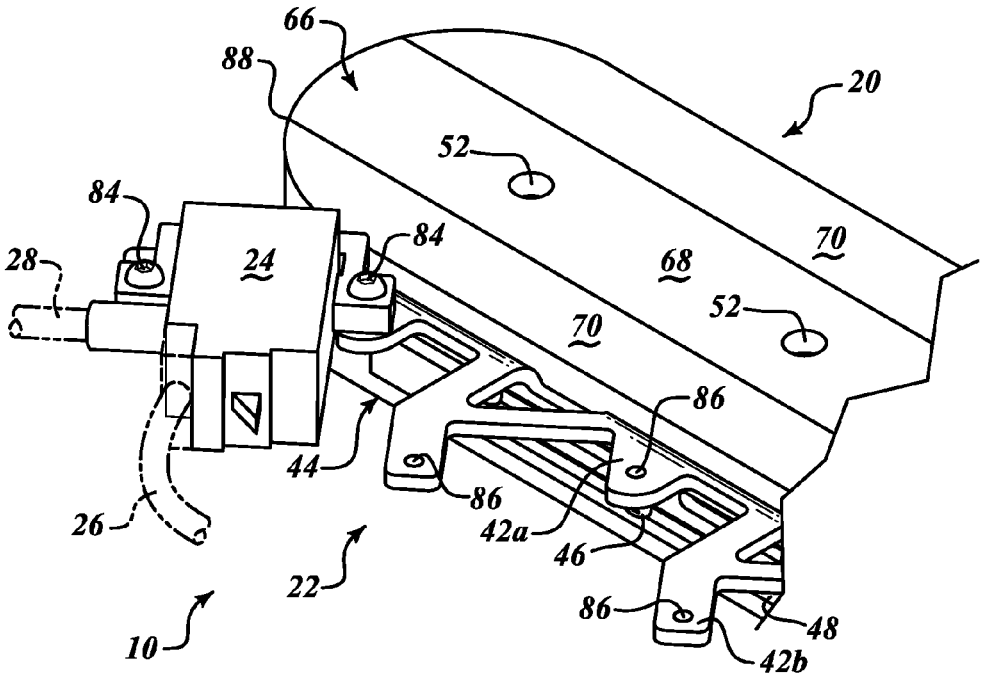
FIG. 4A is an isometric view of a portion of the inventive assembly showing a first embodiment of the side-mount coil bracket having angled coil mounting arms.
Figure 4B:
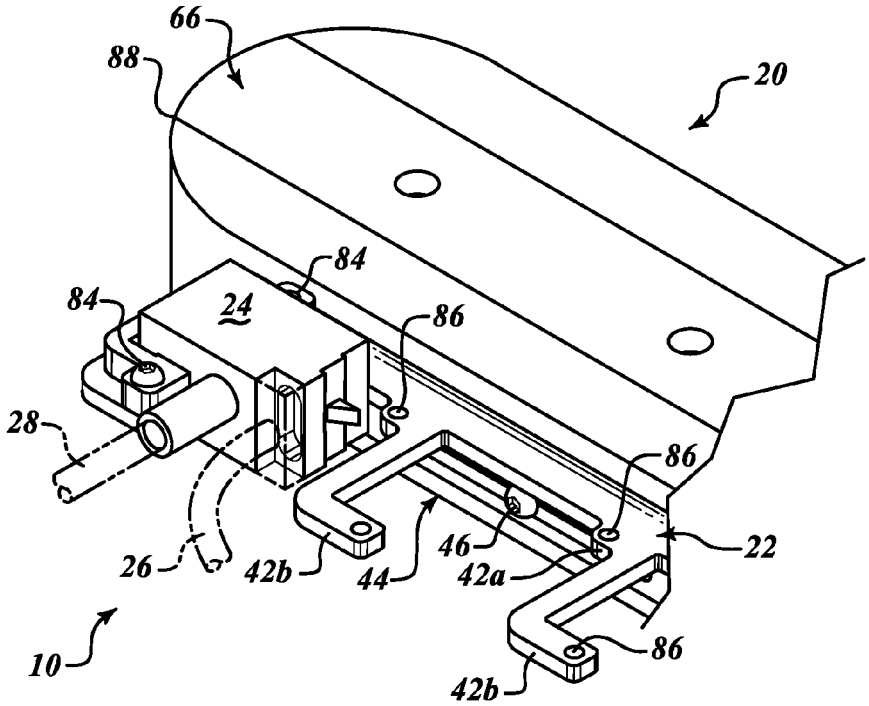
FIG. 4B is an isometric view of a portion of the inventive assembly showing a second embodiment of the side-mount coil bracket having orthogonal coil-mounting arms.

As best seen in FIGS. 4A and 4B, the coil bracket 22 is secured to one of the longitudinal side walls 90 of the housing 20 with a plurality of screws 46, typically from 2 to 5 which pass through a series of staggered slots 48 in the foot 44 of the bracket. Importantly, the slots permit the bracket to be slid forward or back with respect to the ends of the housing 88 to permit clearance and orientation in the engine compartment of the coils with respect to the spark plugs, the exhaust manifold or other wiring or fittings on the engine. FIGS. 4A and 4B show two variations of the coil bracket 22, FIG. 4A showing an angled bracket, that is, a first version in which the arms 42*b* are angled to permit use of a coil 24 that has a long nozzle, while FIG. 4B shows a second version in which the arm 42*b* are orthogonal to the longitudinal backbone of the bracket for use with short nozzle coils. The coil feed wire s 26 and plug supply wires 28 are shown schematically in these figures. In both figures, the coils 24 are secured to the arms 42*a*, 42*b* by screws 84 threaded into holes 86.

Figure 5:
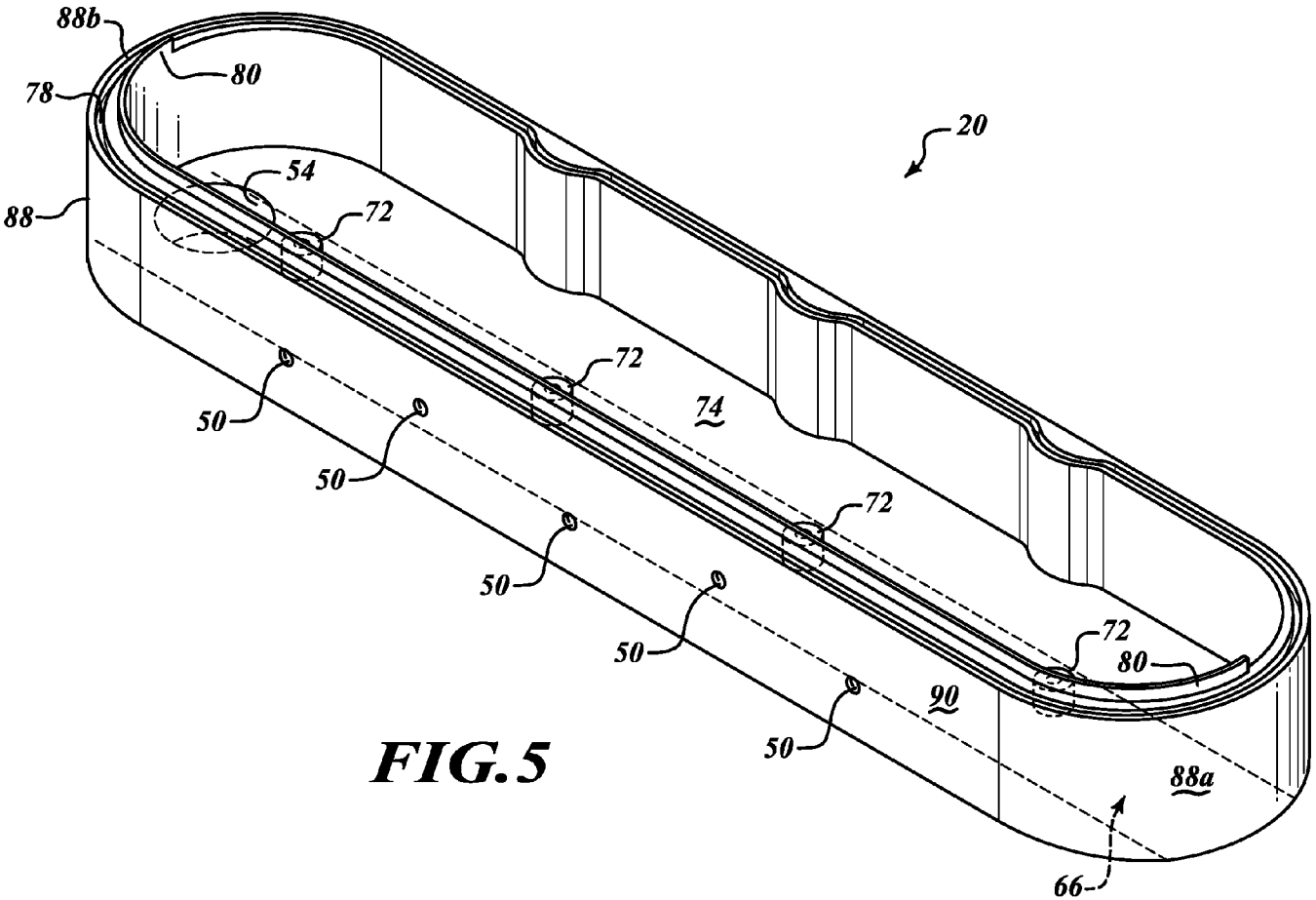
FIG. 5 is an isometric view of the underside of the inventive RAC assembly housing showing the mounting bosses on the underside of the top, the exit of the oil fill/PCV valve port, the sealing groove and the drip rail.

FIG. 5 shows the underside of the housing 20 showing the unthreaded bosses 72 projecting downwardly (upwardly in the figure) from the underside of the top 66. The rocker arm chamber 74 is defined by the generally U-shaped housing (as seen in transverse cross-section; see FIGS. 3A, 3B). A partial lip 80 extending downwardly from the side wall of the open bottom of the rocker arm chamber 74 spans from one short transverse (curved) end wall 88*a*, along the outboard wall 90 and terminates in a corresponding location at the other transverse end wall at 88*b*. This lip engages a groove in the head, assisting in centering the RAC assembly properly on the head. In addition a flanged sealing ring 76, shown in FIGS. 3A/3B is fitted in a groove 78 in the bottom marginal edge of side wall 90 all the way around the rocker arm chamber 74 to prevent oil leak. Thus, in the inventive RAC assembly, the "wet" rocker arm chamber 74 is isolated from the "dry" external electronic coils 24 mounted on the bracket 22, yet oil can be added through the oil filler port 54 that communicates from the exterior top surface 68 by removal of the cap 34.

Note the port 54 is a dual function conduit, functioning either as an oil fill conduit or a PCV valve vapor conduit, as it passes through the upper/top horizontal wall 66 from the rocker arm chamber recess 74. As shown, the housing 20 is machined out of mono-block aluminum.

Thus, the invention is directed to an improved, exposed combined ignition coil and RAC housing assembly for internal combustion engines having Distributorless Ignition Systems, that is mountable to the head of an internal combustion engine, comprising an elongated, longitudinally extending, open-bottom shell housing, having generally an inverted-U shape in vertical cross-section, a pair of spaced vertical longitudinally extending side walls that are joined at each end by end walls that are continuations of and join the respective side walls, the bottom of said side walls being configured to sealingly engage the head of an internal combustion engine in mounted position and said continuous side and end walls being joined by a generally horizontal top wall; said shell defining a wet rocker arm chamber to cover the rocker arm assembly of said engine head; a generally L-shaped coil mounting bracket configured to receive a plurality of coils mounted in generally parallel relationship thereon so that sockets of said coils can be directly accessed and engaged with plug wires; said coil mounting bracket having a generally vertical foot portion and a generally horizontal coil mounting portion comprising a plurality of arms to which coils are mounted; said coil mounting bracket is adjustably mounted to the exterior of a vertical longitudinal side wall of said housing; and a passage extending through said top and permitting communication into said rocker arm chamber from the exterior, said port providing the dual functions of oil fill and crankcase vapor exhaust.

In addition the inventive assembly comprises the additional features of said passage being closable by at least one of a cap and a PCV valve assembly. The top wall includes a plurality of holes for receiving mounting bolts, said holes are cooperatingly aligned with threaded mounting holes in said engine head so that said housing assembly is mountingly secured to said head by bolts through said holes in said top wall. The bracket foot includes a plurality of slots permitting longitudinal adjustment fore and aft of said bracket with respect to the end walls of said housing. The marginal edge of said open bottom includes a groove for receiving a seal member to assist in sealing said assembly to said engine head. The assembly includes a lip depending from at least a portion of said marginal edge of said open bottom to assist in alignment of said assembly to said engine head. This alignment lip extends along at least a portion of the bottom marginal edge of said vertical side wall to which said bracket foot is mounted and the lip extends at least part way around transverse end walls joining said longitudinal side walls.

Additionally the top wall passage comprises an oil fill tube and which includes a closure cap having a stem for sealingly engaging said oil fill tube to permit adding oil directly to said rocker arm chamber without removal of said coil bracket. Preferably, the oil fill tube includes a tang that cooperatingly engages a bayonet slot in said cap stem to cammingly tighten said cap down onto the top of said housing top, and the cap includes an O-ring seal that sealingly engages a shoulder adjacent the inlet end of said oil fill tube. In the alternative, the top wall passage comprises a crankcase vapor passage and includes a PCV valve disposed in said crankcase vapor passage communicating with an air intake air manifold of said engine. Preferably, the crankcase vapor passage conduit includes threads into which a PCV valve may be screwed. The bracket arms are configured to mount said coils in an orientation ranging from orthogonal to the longitudinal center line of said housing and at an acute angle with respect to said center line.

The inventive exposed coil bracket RAC chamber assembly can be used on an internal combustion engine having a V8 configuration of two banks of 4 cylinders, a cylinder head for each bank, and an exposed inventive coil and rocker arm cover assembly secured to each head. Preferably, one of said improved exposed coil RAC assemblies includes an oil fill cap and a second one, mounted to the same engine, includes a PCV valve assembly mounted in the top wall passage.

INDUSTRIAL APPLICABILITY

It is clear that the inventive exposed coil rocker arm cover assembly having an external multi-coil mounting bracket of this application has wide applicability to the automotive industry, namely to engines having Distributorless Ignition Systems. The inventive RAC assembly clearly provides simplicity of mounting and independent access of the coils, of direct oil fill, and to the rocker arms. The external coil bracket permits removal of all coils for independent checking, replacement or servicing simply by removal of bracket mounting screws, while the rocker arm chamber remains intact and undisturbed. In addition, the coils are maintained dry and not exposed to the oil in the wet rocker arm chamber. Thus, the inventive RAC assembly has the clear potential of becoming adopted as a new standard for apparatus and methods of co-mounting coils of DIS systems and rocker arm covers in a single, robust unit.

It should be understood that various modifications within the scope of this invention can be made by one of ordinary skill in the art without departing from the spirit thereof and without undue experimentation. For example, the longitudinal base housing can have a wide range of configurations to provide different engine head designs with the functionalities disclosed herein. In addition, the improved, inventive RAC unit may be fitted with two conduits, e.g., one at each end, with one fitted to function as an oil fill tube and the other fitted with a PCV valve. This invention is therefore to be defined by the scope of the appended claims as broadly as the prior art will permit, and in view of the specification if need be, including a full range of current and future equivalents thereof.

| | |
|---|---|
| 10 | Inventive exposed coil bracket RAC Assembly unit |
| 12 | Driver's Side Cylinder head |
| 14 | Passenger Side Cylinder head |
| 16 | Engine |
| 18 | |
| 20 | Rocker Arm Housing |
| 22 | Side Mount Coil Bracket |
| 24 | Coil |
| 26 | Supply lead to coils |
| 28 | Coil output leads to spark plugs |

-continued

| | |
|---|---|
| 30 | Spark plugs |
| 32 | Housing retaining bolts |
| 34 | Oil fill cap assembly |
| 36 | PCV valve assembly |
| 38 | Outlet vapor line to air intake shroud |
| 40 | Air intake shroud |
| 42a, b | Sets of coil bracket mounting arms |
| 44 | Slotted bracket foot, 2-5 slots |
| 46 | Bracket mounting screws |
| 48 | Slots in bracket foot for adjustment |
| 50 | Threaded holes in housing side wall |
| 52 | Recess in housing top for bolts 32 |
| 54 | Port |
| 56 | Tang in port bore |
| 58 | Helical groove in cap shank for tang |
| 60 | Cap shank or neck |
| 62 | O-Ring in Cap or PCV Valve |
| 64 | Port lip or cuff |
| 66 | Housing top, horizontal wall |
| 68 | Housing top flat area |
| 70 | Top Shoulders |
| 72 | Bored stud for housing retaining bolt 32 |
| 74 | Rocker Arm recess formed by housing |
| 76 | Marginal flanged seal, bottom of side wall |
| 78 | Slot for seal flange |
| 80 | Partial circumference lip |
| 82 | PCV Valve Assembly |
| 84 | Coil fastening screws |
| 86 | Threaded holes for coil retaining screws |
| 88 | Rounded end of housing |
| 90 | Vertical side wall of housing |
| 92 | Cap outer margin, knurled or scalloped |
| 94 | Threaded inner bore of port 54for PCV |
| 96 | |
| 98 | |
| 100 | |
| 102 | |
| 104 | |
| 106 | |
| 108 | |
| 110 | |
| 112 | |
| 114 | |
| 116 | |
| 118 | |
| 120 | |
| 122 | |
| 124 | |

The invention claimed is:

1. An improved combined exposed ignition coil and rocker arm cover assembly for internal combustion engines having Distributorless Ignition Systems, said assembly being mountable to the head of said internal combustion engines, comprising in operative combination:

a, an elongated, longitudinally extending, open-bottom shell housing, having generally an inverted-U shape in vertical cross-section, a pair of spaced vertical longitudinally extending side walls that are joined at each end by end walls that are continuations of and join the respective side walls, the bottom of said side walls being configured to sealingly engage the head of an internal combustion engine in mounted position and said continuous side and end walls being joined by a generally horizontal top wall;

b. said shell defining a wet rocker arm chamber to cover the rocker arm assembly of said engine head;

c. a generally L-shaped coil mounting bracket configured to receive a plurality of coils mounted in generally parallel relationship thereon so that sockets of said coils can be directly accessed and engaged with plug wires;

d. said coil mounting bracket having a generally vertical foot portion and a generally horizontal coil mounting portion comprising a plurality of arms to which coils are mounted;

e. said coil mounting bracket is adjustably mounted to the exterior of a vertical longitudinal side wall of said housing; and f. a passage extending through said top and permitting communication into said rocker arm chamber from the exterior, said passage providing the dual functions of oil fill and crankcase vapor exhaust.

2. An improved exposed coil and rocker arm cover assembly as in claim 1 wherein said passage is closable by at least one of a cap and a PCV valve assembly.

3. An improved exposed coil and rocker arm cover assembly as in claim 1 wherein said top wall includes a plurality of holes for receiving mounting bolts, said holes are cooperatingly aligned with threaded mounting holes in said engine head so that said housing assembly is mountingly secured to said head by bolts through said holes in said top wall.

4. An improved exposed coil and rocker arm cover assembly as in claim 3 wherein said bracket foot includes a plurality of slots permitting longitudinal adjustment fore and aft of said bracket with respect to the end walls of said housing.

5. An improved exposed coil and rocker arm cover assembly as in claim 1 wherein the marginal edge of said open bottom includes a groove for receiving a seal member to assist in sealing said assembly to said engine head.

6. An improved exposed coil and rocker arm cover assembly as in claim 5 which includes a lip depending from at least a portion of said marginal edge of said open bottom to assist in alignment of said assembly to said engine head.

7. An improved exposed coil and rocker arm cover assembly as in claim 6 wherein said alignment lip extends along at least a portion of the bottom marginal edge of said vertical side wall to which said bracket foot is mounted.

8. An improved exposed coil and rocker arm cover assembly as in claim 7 wherein said lip extends at least part way around transverse end walls joining said longitudinal side walls.

9. An improved exposed coil and rocker arm cover assembly as in claim 2 wherein said passage comprises an oil fill tube and which includes a closure cap having a stem for sealingly engaging said oil fill tube to permit adding oil directly to said rocker arm chamber without removal of said coil bracket.

10. An improved exposed coil and rocker arm cover assembly as in claim 9 wherein said oil fill tube includes a tang that cooperatingly engages a bayonet slot in said cap stem to cammingly tighten said cap down onto the top of said housing top.

11. An improved exposed coil and rocker arm cover assembly as in claim 10 wherein said cap includes an O-ring seal that sealingly engages a shoulder adjacent the inlet end of said oil fill tube.

12. An improved exposed coil and rocker arm cover assembly as in claim 2 wherein said passage comprises a crankcase vapor passage and which includes a PCV valve disposed in said crankcase vapor passage communicating with an air intake air manifold of said engine.

13. An improved exposed coil and rocker arm cover assembly as in claim 12 wherein said crankcase vapor passage conduit includes threads into which a PCV valve may be screwed.

14. An internal combustion engine having a V8 configuration of two blocks of 4 cylinders, a cylinder head for each block, and a coil and rocker arm cover of claim 1 secured to each head.

15. An internal combustion engine as in claim 14 where in one of said rocker arm covers has an oil fill tube and the other has a crankcase vapor passage.

16. An improved exposed coil and rocker arm cover assembly as in claim 1 wherein said bracket arms are configured to mount said coils in an orientation ranging from orthogonal to the longitudinal center line of said housing and at an acute angle with respect to said center line.

* * * * *